US006817515B2

(12) United States Patent
Winnett

(10) Patent No.: US 6,817,515 B2
(45) Date of Patent: Nov. 16, 2004

(54) VERIFIABLE VOTING

(75) Inventor: Steven Winnett, Brookline, MA (US)

(73) Assignee: Level 3 Communications, Inc., Broomfield, CO (US)

( * ) Notice: Subject to any disclaimer, the term of this patent is extended or adjusted under 35 U.S.C. 154(b) by 0 days.

(21) Appl. No.: 09/842,533

(22) Filed: Apr. 25, 2001

(65) Prior Publication Data

US 2002/0158118 A1 Oct. 31, 2002

(51) Int. Cl.[7] ..... G07C 13/00

(52) U.S. Cl. ..... 235/51; 235/386; 235/51 R; 235/51 B; 705/12

(58) Field of Search ..... 235/386, 51 B, 235/51 R, 51, 375; 705/12; 707/102

(56) References Cited

U.S. PATENT DOCUMENTS

| | | | | | |
|---|---|---|---|---|---|
| 4,015,106 | A | * | 3/1977 | De Phillipo | 235/54 F |
| 5,189,288 | A | * | 2/1993 | Anno et al. | 235/386 |
| 5,278,753 | A | * | 1/1994 | Graft, III | 705/12 |
| 5,400,248 | A | * | 3/1995 | Chisholm | 705/12 |
| 5,495,532 | A | * | 2/1996 | Kilian et al. | 380/30 |
| 5,610,383 | A | * | 3/1997 | Chumbley | 235/386 |
| 5,875,432 | A | * | 2/1999 | Sehr | 705/12 |
| 5,878,399 | A | * | 3/1999 | Peralto | 705/12 |
| 6,081,793 | A | * | 6/2000 | Challener et al. | 705/50 |
| 6,175,833 | B1 | * | 1/2001 | West et al. | 707/102 |
| 6,250,548 | B1 | * | 6/2001 | McClure et al. | 235/51 |
| 6,317,833 | B1 | * | 11/2001 | Jakobsson | 713/181 |

OTHER PUBLICATIONS

Lynn Investigates . . .—Offshore Company Captures Online Military Vote, "Offshore Company Captures Online Military Vote," http://www.ecotalk.org/SERVEaccenture.htm, (Mar. 1, 2004), 2 pages.

Lynn Investigates . . .—EcoTalk, "Internet Voting—The End of Democracy?, " http://www.ecotalk.org/InternetVoting.htm, (Mar. 1, 2004), 2 pages.

Lynn Investigates . . .—California Recall, "Republicans and Brits Will Count California's Recall Votes," http://www.ecotalk.org/CaliforniaRecall.htm, (Mar. 1, 2004), 2 pages.

Lynn Investigates . . .—VotingMachineErrors, "Election Fraud and Irregularities—By Year," http://ecotalk.org/VotingMachineErrors.htm, (Mar. 1, 2004), 13 pages.

Lynn Investigates . . .—Voting Security, "Any Voting Machine Violates Your Right to Vote and to watch your vote counted properly," http://www.ecotalk.org/VotingSecurity.htm, (Mar. 1, 2004), 4 pages.

Lynn Investigates . . .—Dr.RebeccaMercuir, "The Nightmare Scenario Is Here—computer Voting With No Paper Trail," http://www.ecotalk.org/Dr.RebeccaMercuriComputerVoting.htm, (Mar. 1, 2004), 2 pages.

Lynn Investigates . . .—VotingMachinesUnconstitutional, "voting Machines Violate Constitution—Who Will Launch Legal Challenge?," http://www.ecotalk.org/VotingMachinesUnconstitutional.htm (Mar. 1, 2004), 2 pages.

Lynn Investigates . . .—EcoTalk, "NIST Ignore Scientific Method for Voting Technology," http://www.ecotalk.org/NIST.htm, (Mar. 1, 2004), 3 pages.

(List continued on next page.)

*Primary Examiner*—Karl D. Frech
*Assistant Examiner*—Ahshik Kim
(74) *Attorney, Agent, or Firm*—Faegre & Benson LLP

(57) ABSTRACT

A method of verifiable voting includes receiving election selections, producing a receipt representation of the election selections, the receipt having a unique receipt number for a voter and publishing election results, the election results including the election selections and unique receipt number.

29 Claims, 4 Drawing Sheets

| | | President | Senate | Congress | Governor |
|---|---|---|---|---|---|
| 320A | ADF358309 | Smith | Johnson | Green | Flay |
| 320B | AWD452097 | Smith | Wilson | Green | Flay |
| 320C | DTG983012 | Smith | Wilson | Blue | Swelter |
| 320D | HUJ710982 | Jones | Wilson | Green | Swelter |
| 320E | RTW409812 | Jones | Johnson | Green | Flay |

310
340

OTHER PUBLICATIONS

Lynn Investigates . . .—As each choice changes, "An analysis of 'solutions' to the problem of paperless voting," http://www.ecotalk.org/VotingSolutions.htm, (Mar. 1, 2004), 4 pages.

Lynn Investigates . . .—Vote–By–Mail, "Voting Machines—A High Tech Ambush," http://www.ecotalk.org/Vote–By–Mailproblems.htm, (Mar. 1, 2004), 2 pages.

Lynn Investigates . . .—VotingMachineCompanies–Crooked?, "Elections In America—Assume Crooks Are In Control," http://www.ecotalk.org/American Elections.htm (Mar. 1, 2004), 3 pages.

Lynn Investigates . . .—VoterNewsService, "Election Night Projections—Cover For Vote Rigging Since 1964?," http://www.ecotalk.org/VoterNewsService.htm, (Mar. 1, 2004), 2 pages.

Jones, Douglas W., Douglas W. Jones Illustrated Voting Machine History,"A Brief Illustrated History of Voting," The University of Iowa Department of Computer Science, http://www.cs.uiowa.edu/~jones/voting/pictures/, (Mar. 1, 2004), 15 pages.

* cited by examiner

VERIFIABLE VOTING

TECHNICAL FIELD

This invention relates to voting.

BACKGROUND

Current voting techniques do not provide a voter with the ability to verify that their vote has been counted, and counted correctly. Typically, a voter enters a voting booth at a polling station, makes their voting choices by ballot and then exits the voter booth. In general, the actual tallying of votes is made later, after polls have closed, either by hand counting by election officials or by a ballot-counting machine. The tallying process does not provide any means for each voter to verify that his or her vote was counted, and counted correctly.

SUMMARY

According to an aspect of this invention a method of verifiable voting includes receiving election selections, producing a receipt representation of the election selections, the receipt having a unique receipt number for a voter, and publishing election results, the election results including the election selections and unique receipt number.

One or more of the following features may also be included: responding to choices displayed by a computer to make election selections, entering a voter station where the voter station is a voting booth located at a polling place, entering a voter station, where the voter station is an electronic connection to the computer, and responding to choices transmitted by the computer to make election selections, printing a receipt at the polling place, printing a receipt in the voter booth, listing a receipt number and election selections on an electronic medium, entering a voter station where the voter station is a mail in ballot, mailing a printed receipt in response to the mail in ballot, entering a voting station where the voter station is a telephone connection to a polling place, and responding to election choices transmitted over the telephone connection to make election choices, printing election results in a printed media, printing election results, and posting the results in a public place, posting election results to an electronic bulletin board, calling a telephone access system having a means of entering the receipt number, the system also having a means of responding to an entered receipt number, entering the receipt number, and receiving a response for the election selections which correspond to the receipt number.

According to a further aspect of this invention, a computer program stored on a computer-readable medium, the computer program including instructions that cause a computer to output election choices, receive election selections, and produce a receipt representation of the election selections, the receipt having a unique receipt number for a voter.

One or more of the following features may also be included: instructions to cause the computer to: output election results to an electronic media, the election results including the election selections and unique receipt number where the electronic media includes an electronic bulletin board, determine whether all election selections are completed, and if the election selections are completed then produce the receipt, and determine whether a voter has indicated completion of the selection process, and if the voter indicates completion produce the receipt.

Embodiments of the invention may have one more of the following advantages. Verifiable voting provides a receipt with a unique identifying number to each voter after making election choices at a voting station. The method includes a publishing process so that each voter can verify that their votes were counted and counted correctly.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

As used herein, 'receipt number' refers to a unique identifying number assigned to each voter in an election.

As used herein, 'election results' refers to the election selections made by one or more voters participating in a specific election. 'Election results' may also include receipt numbers which correspond to election selections made by each voter in a specific election.

Figure 1:
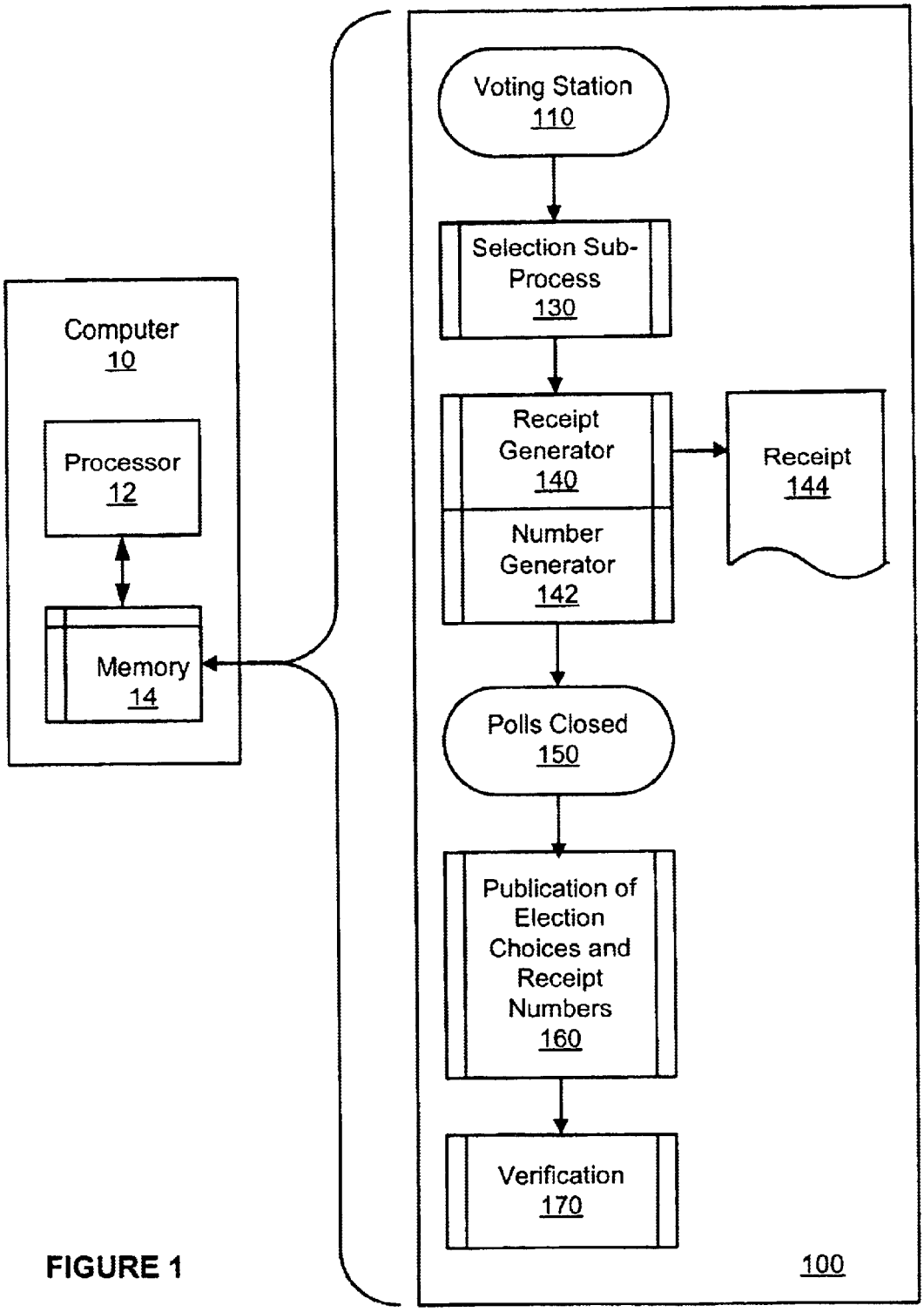
FIG. 1 is a flow diagram of a voting process.

Referring to FIG. 1, a verifiable voting process 100 executing in a computer system 10, includes a voter entering a voting station 110. The computer 10 includes a processor 12 and a memory 14. Memory 14 stores machine-executable instructions and an operating system. Instructions are executed by the processor to perform the verifiable voting process 100. Memory 14 also contains a list of election choices which are available for an election. Voting process 100 executes selection sub-process 130 that outputs the list of voter choices and receives voter selections. Upon completion of selection sub-process 130, process 100 generates 140 a voter receipt 144 for the voter. The generation 140 of voter receipt 144 includes a number generator process 142 to produce a unique voter identification number.

The voter exits the voting station with their voter receipt 144. Upon closing 150 of the polls, the election results for the voting station are published 160 and the results verified 170. Verification 170 allows the voter to determine that their list of voter selections was received and counted correctly. The voter receipt is private and given only to the voter such that the voter can confidentially verify their election selections.

Figure 2:
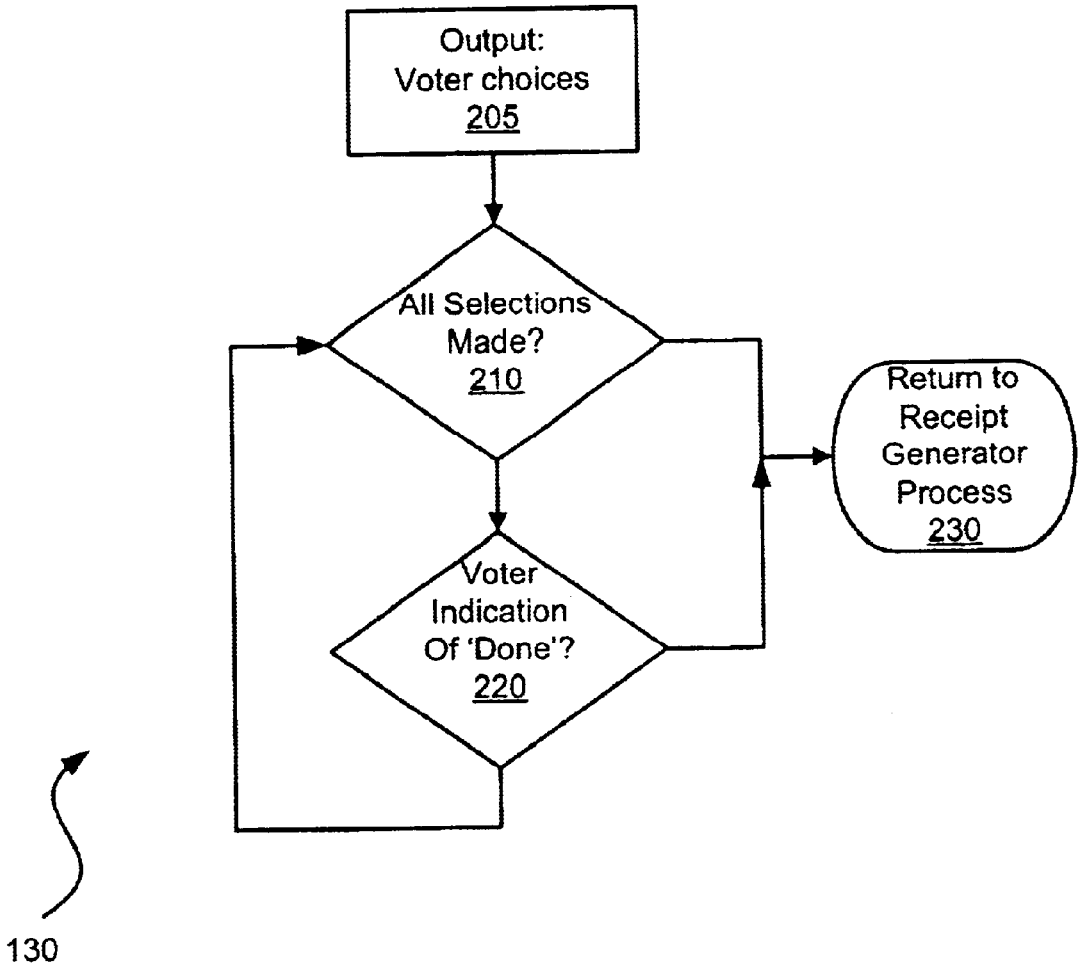
FIG. 2 is flow diagram of a selection sub-process.

Referring to FIG. 2, an selection sub-process 130 includes outputting voter choices 205 and determining 210 whether all voter selections have been made. If all voting selections have been made, the sub-process 130 returns 230 to the receipt generator 140 and generates a receipt 144 for the voter. Otherwise, the sub-process 130 determines 220 whether a voter has indicated they are finished. If finished, the sub-process 130 returns 230 to the receipt generator 140 and generates a receipt for the voter.

Figure 3:
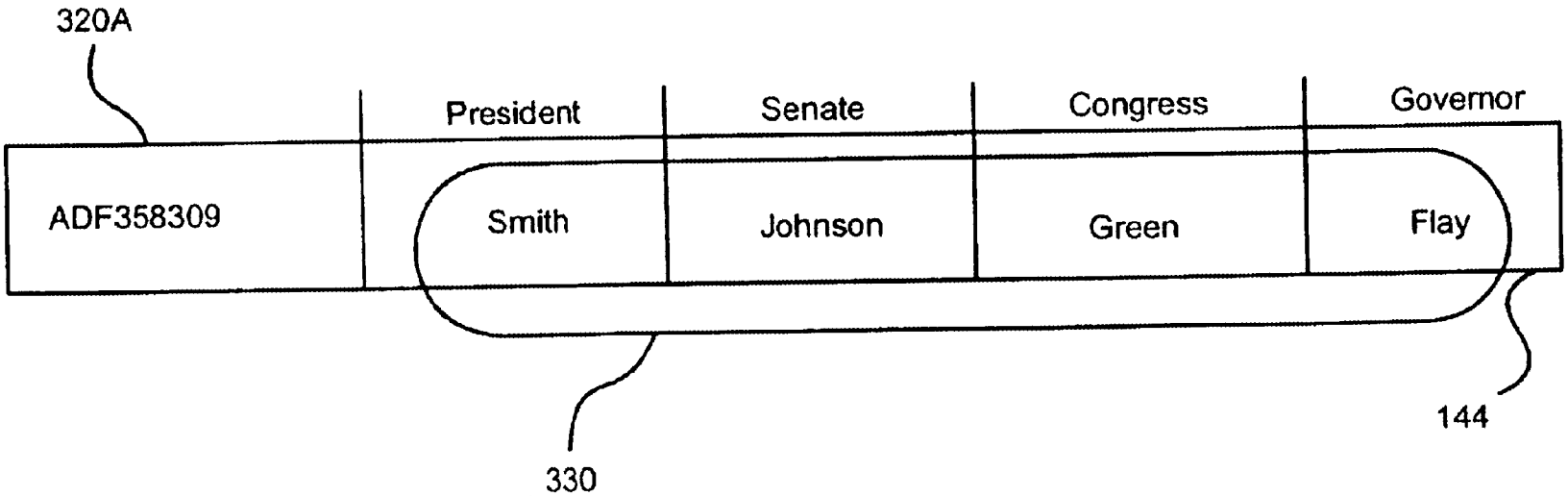
FIG. 3 is a depiction of an exemplary voting receipt.

Referring to FIG. 3, an exemplary voter receipt includes election selections 330 and the receipt number 320A for voter 110.

Figure 4:
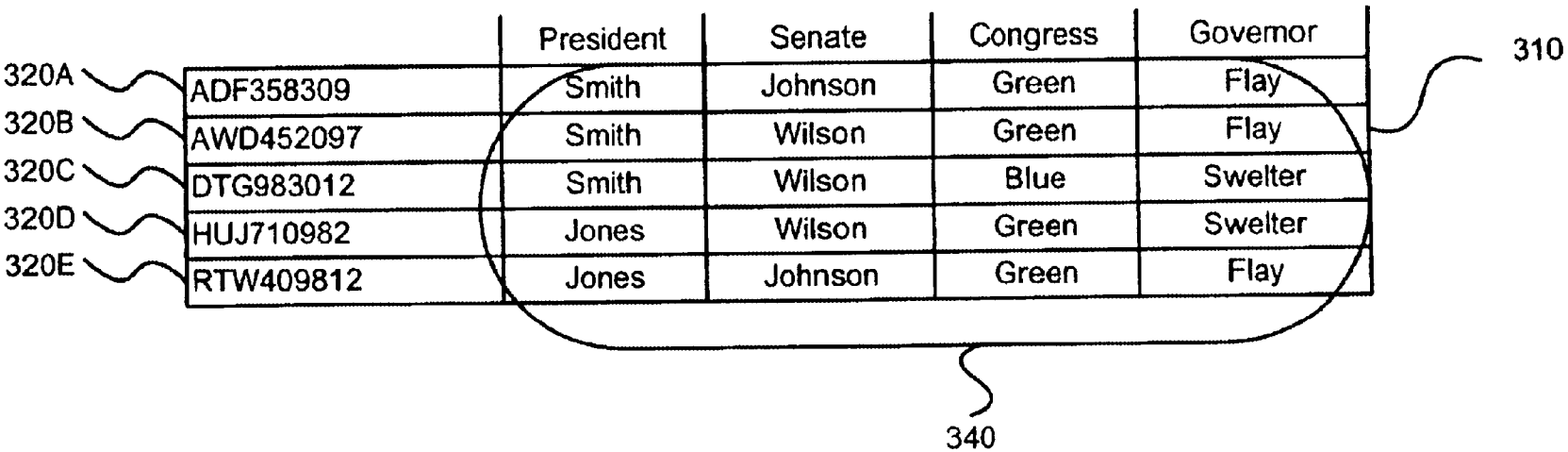
FIG. 4 is a depiction of an exemplary publication of voting results.

Referring to FIG. 4, an exemplary publication 310 includes receipt numbers 320A-320E along with the election selections 340 which correspond to each receipt number.

As used herein, 'polling place' may refer to an actual voting location designated by the local voting authorities. Alternatively, 'polling place' may refer to a phone-access system, or an electronic voting system (i.e. an electronic address where electronic votes may be entered) or the physical address where a mail-in ballot may be mailed (e.g., an absentee ballot).

Entering a voter station may include entering an actual voting booth, i.e., at a polling place. Alternatively, entering a voter station may include entering election selections by phoning, e-mailing (electronically) or filling out a printed ballot and mailing it to the polling place.

Receipt generator 140 may produce a printed receipt at the voting booth, or at the polling place. The receipt number and election selections may also be given to a voter 110 by telephone, electronically (i.e., via e-mail or an electronic file), or a printed receipt sent by U.S. mail. In particular, a voter who makes election selections via an absentee ballot (whether by mail, or in person) is entitled to a voting receipt.

The receipt number produced for each voter who takes part in process 100 is produced by number generator 142. The number generator uses a random number algorithm such as an algorithm based on prime numbers, independent sequences or secure hashing. In order to provide a unique receipt number for every voter in the election, the number generator also maintains a list of previously generated numbers for earlier voters in an election. As long as the total number (the universe) of possible numbers is sufficiently large to provide all voters a unique number, any known random number generator algorithm can be used to generate the receipt numbers. A smaller universe of unique numbers can be used if a voting station includes additional information in the receipt number such as a polling place identifier, a time stamp, a date stamp, a zip code of the polling place, or the voting machine number.

The receipt number generated for each voter may include, at least, alphanumeric characters and numbers. Referring again to FIG. 3, the exemplary receipt number 320A may be lengthened such that a sufficient universe of unique receipt numbers can be generated for each voter in a particular election.

The definition of 'receipt' may include any definition allowed in the jurisdiction where the voting process 100 occurs. The voter 110 may also have the option of not taking a receipt, or not generating a receipt.

Publishing may be accomplished by printing the election results in a printed publication, such as a newspaper, newspaper supplement or magazine. Publishing may also include printing the election results and posting them at a public place, or, listing the election results on an electronic bulletin-board (e.g., an internet web-site), or, broadcasting the election results on television or by radio. Publishing could also include distributing election results on a CD-ROM or other digital media to interested members of the public.

Publishing and verifying could also be accomplished by a telephone access system where a voter could enter their receipt number via voice or touchpad and the election selections corresponding to that receipt number would be given in response over the telephone.

As shown in FIG. 1, publishing 160 occurs after closing 150 the polls. This sequence of events is in keeping with current voting practices of publishing election results only after closing the polls, however, if election laws permitted, publishing could begin sooner than the closing of the polls.

Processes 100 and 130 are not limited to use with the hardware and software configuration of FIG. 1; it may find applicability in any computing or processing environment. Processes 100 and 130 may be implemented in hardware (e.g., an ASIC {Application-Specific Integrated Circuit}, and/or an FPGA {Field Programmable Gate Array}), software, or a combination of hardware and software.

Processes 100 and 130 may be implemented using one or more computer programs executing on programmable computers that each includes a processor, a storage medium readable by the processor (including volatile and non-volatile memory and/or storage elements), at least one input device, and one or more output devices.

Each such program may be implemented in a high level procedural or object-oriented programming language to communicate with a computer system. Also, programs can be implemented in assembly language or machine language. The language may be a compiled or an interpreted language.

Each computer program may be stored on a storage medium or device (e.g., CD-ROM, hard disk, or magnetic diskette) that is readable by a general purpose or special purpose programmable computer for configuring and operating the computer where the storage medium or device is read by the computer to perform processes 100 and 130.

Processes 100 and 130 may also be implemented as a computer-readable storage medium, configured with a computer-readable storage medium, configured with a computer program, where, upon execution, instructions in the computer program cause the computer to operate in accordance with processes 100 and 130.

A number of embodiments of the invention have been described. Nevertheless, it will be understood that various modifications may be made without departing from the spirit and scope of the invention. Accordingly, other embodiments are within the scope of the following claims.

What is claimed is:

1. A method of verifiable voting comprising:

receiving election selection from voter;

producing a receipt representative of the election selections, the receipt having a unique receipt number; and publishing election results, the election results including the election selections add the unique receipt number.

2. The method of claim 1 wherein producing a receipt further comprises:

printing the receipt at the polling place.

3. The method of claim 1 wherein producing a receipt further comprises:

printing the receipt in a voter booth.

4. The method of claim 1 wherein producing the receipt further comprises:

listing a receipt number and election selections on an electronic medium.

5. The method of claim 1 wherein producing a receipt further comprises:

mailing a printed receipt in response to the mail in ballot.

6. The method of claim 1 wherein receiving election selections further comprises:

entering a voting station where the voter station is a telephone connection to a polling place; and responding to election choices transmitted over the telephone connection to make election choices.

7. The method of claim 1 wherein publishing election results further comprises:

printing election results in a printed media.

8. The method of claim 1 wherein publishing election results further comprises:

printing election results; and posting the results in a public place.

9. The method of claim 1 wherein publishing election results further comprises:

posting election results to an electronic bulletin board.

10. The method of claim 1 wherein publishing election results further comprises:

calling a telephone access system having a means of entering the receipt number, the system also having a means of responding to an entered receipt number;

entering the receipt number; and receiving a response for the election selections which correspond to the receipt number.

11. The method of claim 1, wherein the election results include the election selections corresponding to the receipt number and an overall election tabulation, and wherein the voter can access the published election results to verify that the election selections were received and properly incorporated in the overall election tabulation.

12. The method of claim 1, wherein the method further comprises:

providing a computer, wherein the computer is operable to receive the election selections.

13. The method of claim 1, wherein the computer is further operable to provide election choices, and wherein the election selections are a subset of the election choices.

14. The method of claim 1, wherein the method further includes providing the receipt to the voter.

15. A computer program stored on a computer-readable medium, the computer program comprising instructions that cause a computer to:

output election choices;

receive election selections; and produce a receipt representation of the election selections, the receipt having a unique receipt number for a voter.

16. The computer program of claim 15 further comprising instructions to cause the computer to:

output election results to an electronic media, the election results including the election selections and unique receipt number.

17. The computer program of claim 16 wherein the electronic media includes an electronic bulletin board.

18. The computer program of claim 16 wherein the election results which are output are used for publication.

19. The computer program of claim 15 wherein receive election selections further comprising instructions to cause the computer to:

determine whether all election selections are completed, and if the election selections are completed then produce the receipt; and determine whether a voter has indicated completion of the selection process, and if the voter indicates completion produce the receipt.

20. A computer program product on a computer-readable medium for providing a verifiable election, comprising:

instructions for a computer for outputting election choices via a first user interface accessible to a voter;

instructions for a computer for receiving election selections;

instructions for a computer for producing a receipt for the election selections, the receipt having a unique number for a voter; and instructions for a computer for outputting election results via a second interface accessible to the voter.

21. A method for providing transparent election results, the method comprising:

receiving an election selection, for a voter;

producing a receipt indicating the election selection, wherein the receipt includes a receipt number, and displayed an election result, wherein the election result includes an indication of the election selection from the voter and the receipt number, wherein the election selection from the voter and the corresponding receipt number can be used by the voter to determine that the election selection from the voter was properly counted.

22. A method for providing transparent election results, the method comprising:

receiving an election selection from a voter;

producing a receipt indicating the election selection, wherein the receipt includes a receipt number; and displaying an election result, wherein the election result includes an indication of the election selection from the voter and the receipt number, and wherein the election result is accessible to the voter to determine that the election selection of the voter was received.

23. The method of claim 22, wherein the election selection from the voter and the receipt number further used to determine that the election selection of the voter was properly counted.

24. The method of claim 22, wherein the receipt is provided to the voter at a voting location.

25. The method of claim 22, wherein the receipt is printed at a polling location used by the voter.

26. The method of claim 22, wherein the receipt is printed in a voting booth utilized by the voter.

27. The method of claim 22, wherein displaying the election results includes an operation selected from a group consisting of printing the election results, posting the election results in a public place; printing the election results in an electronic format, and posting the election results to an electronic bulletin board.

28. A system for minimizing election fraud, the system comprising:

a computer readable medium, wherein the computer readable medium includes instructions executable by a computer processor to:

display election choices;

receive election selections from a voter;

produce a receipt representative of the election selections, wherein the receipt includes a unique receipt number, and wherein the receipt is accessible by a recipient; and display election results, wherein the election results include election selections corresponding to the unique receipt number and to an overall election tabulation, and wherein the display election results are accessible by the recipient.

29. A method for providing transparent election results, the method comprising:

receiving an election selection from a voter;

producing a receipt indicating the election selection, wherein the receipt includes a receipt number;

providing the receipt to a recipient; and displaying an election result via a user interface accessible to the recipient, wherein the election result includes an indication of the election selection from the voter and the receipt number corresponding to the voter, wherein the election selection from the voter and the receipt number correspond to the voter can be used to determine that the election selection from the voter was properly counted.

* * * * *